US007134976B1

(12) United States Patent
Smith

(10) Patent No.: US 7,134,976 B1
(45) Date of Patent: Nov. 14, 2006

(54) SPORTS TRAINING DEVICE AND METHOD OF USING THE SAME

(76) Inventor: Paul D. Smith, 9747 Manheim Dr., Las Vegas, NV (US) 89117

( * ) Notice: Subject to any disclaimer, the term of this patent is extended or adjusted under 35 U.S.C. 154(b) by 0 days.

(21) Appl. No.: 10/846,750

(22) Filed: May 14, 2004

(51) Int. Cl.
*A63B 69/00* (2006.01)
*A63B 63/04* (2006.01)

(52) U.S. Cl. ..... 473/446; 273/400; 473/454

(58) Field of Classification Search ..... 273/398–402, 273/127 R, 127 B; 473/439, 446, 454–456, 473/470, 471, 476–478
See application file for complete search history.

(56) References Cited

U.S. PATENT DOCUMENTS 3,197,208 A * 7/1965 Makar ..... 473/190
3,840,228 A * 10/1974 Greaney ..... 473/446
4,245,843 A 1/1981 Griggs
4,607,842 A 8/1986 Daoust
4,826,166 A 5/1989 Baker et al.
4,842,283 A 6/1989 LeBel et al.
D303,824 S * 10/1989 Maloney, II ..... D21/699
4,948,147 A 8/1990 Pallanca
5,238,243 A * 8/1993 Grispi ..... 473/446
5,628,515 A 5/1997 Levy
5,634,640 A * 6/1997 McCarrel ..... 473/446
5,888,153 A 3/1999 Masin
6,402,641 B1 6/2002 Lee
6,695,724 B1 * 2/2004 Birss ..... 473/446
2002/0042312 A1 * 4/2002 Decloux ..... 473/476

* cited by examiner

*Primary Examiner*—Mark S. Graham
(74) *Attorney, Agent, or Firm*—Rob L. Phillips; Greenberg Traurig

(57) ABSTRACT

A training device comprising a target member, having a target face, a target arm and target support facilitates a training regiment for soccer, baseball, football and hockey players. The target support is coupled to a goal post or cross-bar of a goal. The target member is adjustably joined to the target support such that the target member and corresponding target face may be positioned in a plurality of locations without uncoupling the target support. The target face can be positioned in a plurality of positions throughout a vertical plane and may also be adjusted in a direction parallel to the target arm. The adjustability of the target face provides a versatile training device which can be arranged in numerous configurations to maintain fresh training regiments. In practice, multiple training devices maximize the effectiveness of the training. Other features include target face illumination means, counters and speakers for transmitting audio outputs.

25 Claims, 4 Drawing Sheets

SPORTS TRAINING DEVICE AND METHOD OF USING THE SAME

FIELD OF THE INVENTION

The embodiments of the present invention relate to a training device for multiple sports. More particularly, a plurality of adjustable and pivotable targets provide a means for an athlete to improve his or her throwing, shooting and kicking skills.

BACKGROUND

Sports have become a billion dollar a year industry in the United States. Worldwide the numbers are even more staggering. However, the success of sports is not predicated on any single attribute, but rather many attributes. Participating in sports allows players and/or athletes to exercise their bodies, learn team work and sportsmanship and attain common goals and objectives. In addition, many athletes may someday reach the major league in their respective sport.

The success of sports has created a great need to teach players the required skills necessary to excel at a chosen sport or sports. Many sports require players to rely on a great deal of hand-eye or foot-eye coordination. For example, football, baseball, soccer and hockey, to name a few, require such hand-eye or foot-eye coordination. Thus, there is a tremendous need in the sports field for a simple device and method for training such skills as they relate to multiple sports.

While a multitude of issued patents disclose different training devices and methods of use suitable for multiple sports, the devices and methods often suffer drawbacks, including the ease at which athletes master the device and method. Much like a video game that is easily defeated, many of the previous training devices fail to provide significant versatility thereby falling short of furnishing a complete training regiment. More particular to the embodiments of the device and method disclosed herein, previous training devices utilize target systems for training soccer, football and hockey players. Unfortunately, none of the previous target systems incorporate the versatility necessary to adequately and efficiently train an athlete.

In general, target systems seek to train an athlete's hand-eye and foot-eye coordination by repetition. In other words, athletes repeatedly attempt to strike a fixed target with a soccer ball, football, baseball or puck. In this fashion, players are trained to strike a target positioned in a desired location. Nonetheless, the previous target systems are fixed or require substantial effort to re-position the targets from a first location to a second or third location. It is apparent that a target device having target faces capable of being re-positioned quickly and effortlessly will provide significant versatility needed by athletes and will reduce the labor required to utilize the target device.

SUMMARY

Accordingly, the embodiments of the present invention comprise a target device incorporating a means for adjusting a target face, without uncoupling the target device from a rigid structure. The rigid structure may be a soccer goal post, hockey goal post, field goal post or any fixed post.

The target device incorporates a target member, having a target face, a target arm and a target support member. In a first embodiment, one or more target devices are rigidly coupled to one or more goal posts and/or a cross-bar. The target member and corresponding target face is rotatably joined to the target support member by the target arm such that the target face may be adjusted through at least 180° of motion within a goal area. In this arrangement, a single target device can be adjusted quickly without having to uncouple and re-position the entire target device thereby allowing the athlete to spend more time training as opposed to re-positioning training devices. In addition, correctly positioning multiple target devices minimizes the number of target devices needed to cover the same, or more, goal area as former target devices. The capability of quickly re-positioning the target members and faces also provides the athlete with more locations to focus his or her attention and repetition resulting in maximum training benefits.

The rotation of the target member and face is facilitated by the target arm which is rotatable about the support member. In the first embodiment, the support member is circular and provides a plurality of locking positions for the rotating target arm and corresponding target face. In one embodiment, a target device attached to a vertical goal post may have its target face positioned in an upper, lower or horizontal position. Similarly, a target device attached to a horizontal goal post (or cross-bar) may have its target face positioned in a left, right or center position. Of course, as set forth below, additional target face positions are contemplated by the embodiments of the present invention.

Each target arm is comprised of a first arm section and second arm section joined by a hinge device for allowing the first arm section and target face to pivot at least 90° into the goal area in response to being struck by a sports article. Once struck by the sports article, the target face momentarily pivots into the goal area and then, as dictated by the hinge, automatically pivots to its original position. In this manner, the player does not need to constantly manually maintain the target faces during training.

It is envisioned that the versatile target devices of the embodiments of the present invention can be used to, at a minimum, train quarterbacks to throw a football, baseball players to throw a baseball, soccer players to kick soccer balls and hockey players to shoot hockey pucks.

DETAILED DESCRIPTION

Figure 1:
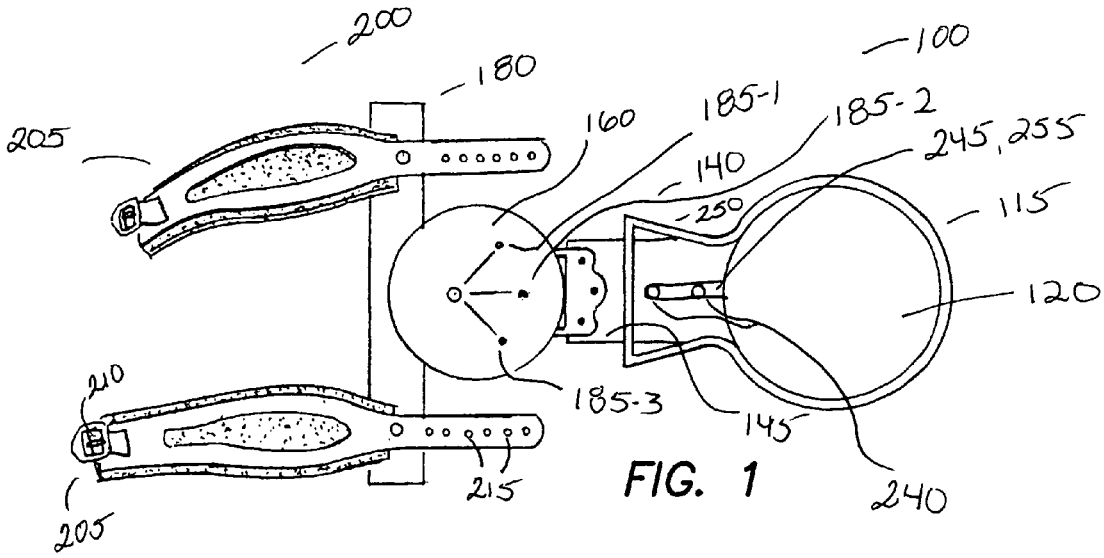
FIG. 1 illustrates a front view of a target device prior to connection to a post.
Figure 2:
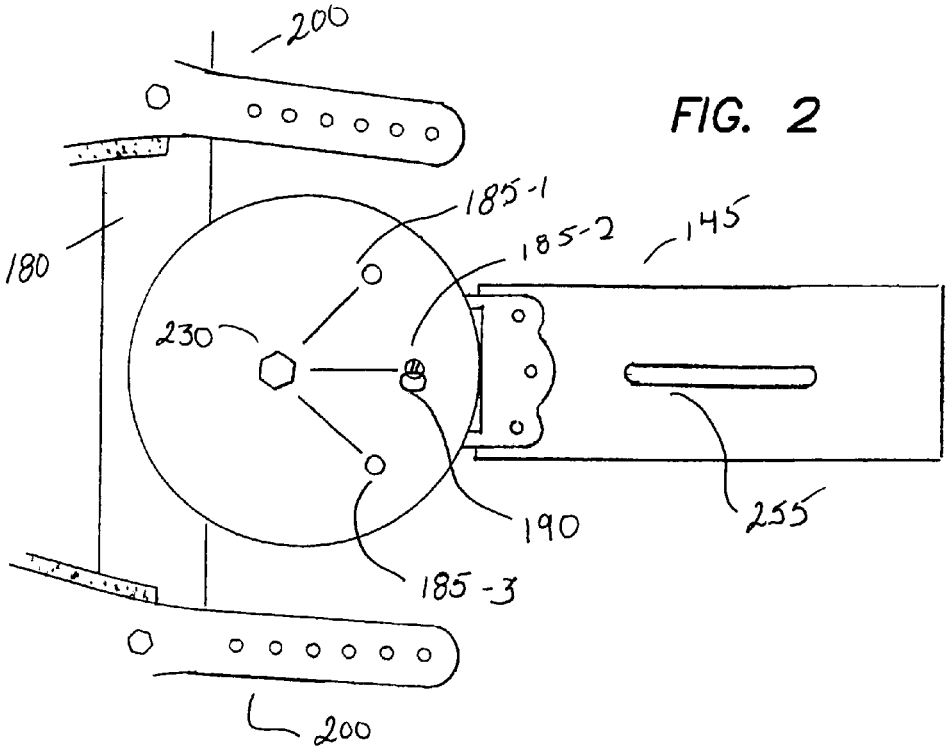
FIG. 2 illustrates a front view of a portion of a target device, more particularly a first arm section, hinge, support member and stem prior to attachment of the target device to a post.

Reference is now made to the figures wherein like parts are referred to by like numerals throughout. FIG. 1 illustrates a front view of a target device generally designated as reference numeral 100. The target device comprises a target member 115, having a target face 120, target arm 140, target support member 160, strut 180 and straps 200.

Figure 3:
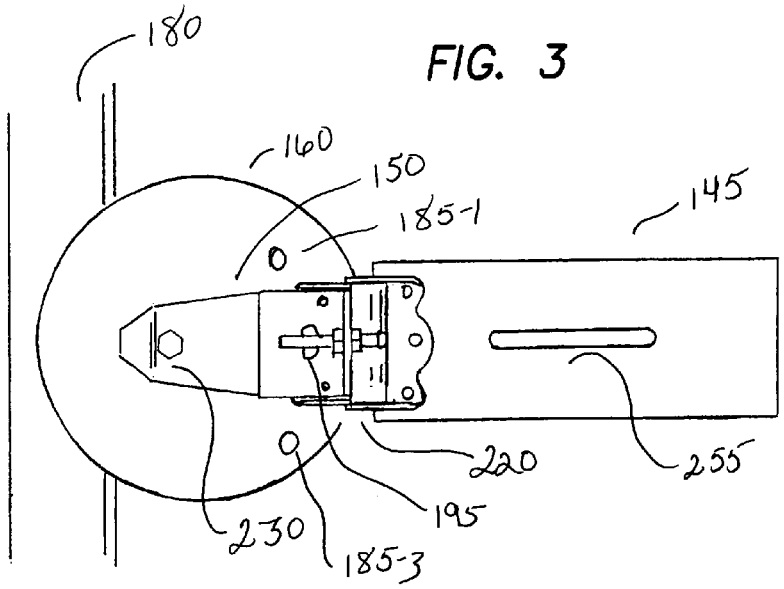
FIG. 3 illustrates a rear view of a portion of the target device, more particularly, the first arm section, second arm section, hinge, support member and strut prior to attachment of target device to a post.
Figure 7:
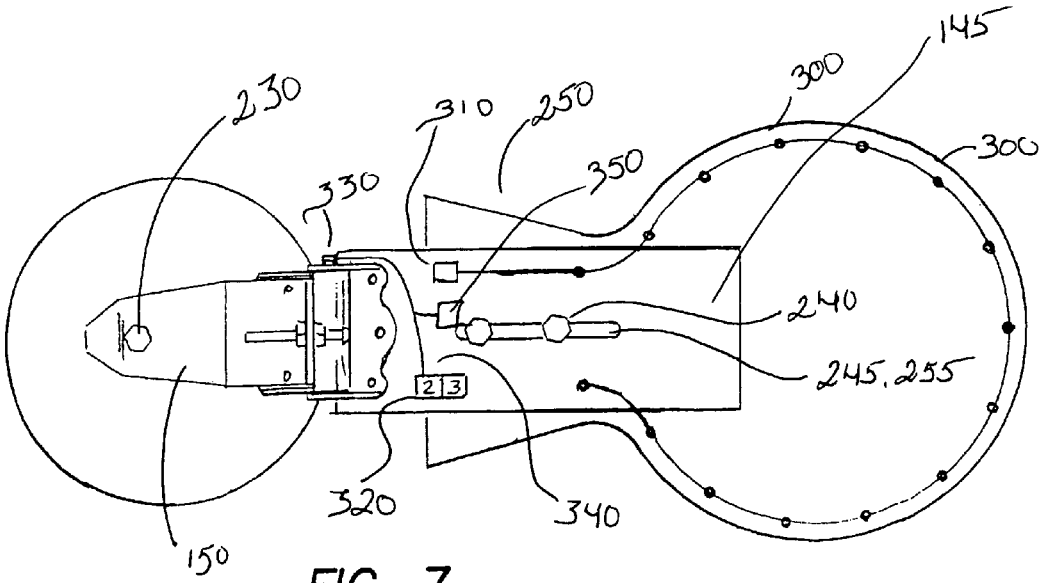
FIG. 7 is an illustration of a rear view of a portion of the target device showing other features of the training device including audible and visual indicators and an electrical counter.

The target arm 140 includes a first arm section 145 and a second arm section 150 (shown in FIGS. 3, 7). The first arm section 145 extends from its connection with hinge 220 (shown in FIGS. 3, 7) to support the target face 120. A second arm section 150 extends from its connection with hinge 220 to behind the support member 160. The spring-biased hinge 220 enables the target face 120 (and the first arm section 145 of the target arm 140) to pivot approximately 90° in response to being struck by a sports article (e.g., soccer ball, baseball, football, puck, etc.). As described below, in this manner, the target face 120 is generally removed momentarily from a goal area. The spring-biased hinge 220 automatically returns the first arm section 145 and corresponding target face 120 to their original position. The automatic nature of the target device 100 permits the user to optimize training time rather than spending wasteful time repositioning the target face 120.

Figure 4:
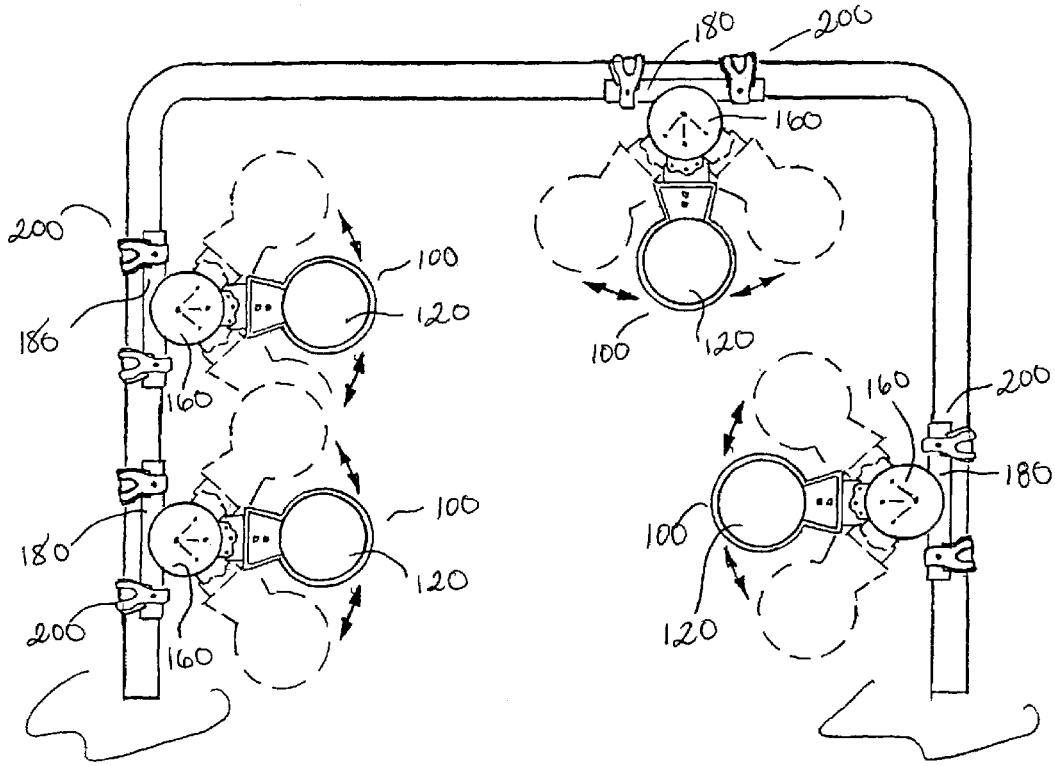
FIG. 4 illustrates a front view of multiple target devices coupled to soccer goal posts and a cross-bar and illustrates alternative positions of target members and target faces (shown in dotted lines)

As illustrated in FIG. 4, the support member 160 provides three different target member 115 or target face 120 positions (target face and target member are used synonymously herein). It is recognized that many more target face positions are available in practice. As shown in FIGS. 1–3 and 7, to facilitate the different positions of the target face 120, the target arm 140, more particularly the second arm section 150, is rotatably joined to a rear portion of the circular support member 160 by a nut, bolt and washer assembly 230. Three adjustment apertures 185-1 through 185-3 in combination with an adjustment pin 190 provide a simple means for securing the target face 120 in a desired position throughout a generally vertical plane. Once the target face 120 is arranged as desired, the pin 190 is inserted through the proper adjustment aperture 185-1, 185-2 or 185-3 and then through an opening 195 in the second arm section 150.

Alternatively, multiple adjustment pins may be rigidly joined to a backside of the target support member 160. One of the rigid pins can then be inserted through opening 195 to hold the target face 120 in place as desired. In either embodiment or others, more than three adjustment apertures 185-1 through 185-3 or three adjustment pins may be incorporated to provide additional target face 120 positions and a greater range of motion.

The embodiments of the present invention further provide means for the target face 120 to be adjusted longitudinally along the target arm 140, specifically first arm section 145. In a first embodiment, the means comprises one or more nut and bolt combinations 240. An elongated opening 245 in a target face extension 250 is aligned with a slot 255 in the first arm section 145. To longitudinally adjust the target face 120, the target face 120 is first arranged in a desired position along the target arm section 145. Then, one or more nut and bolt combinations 240 are used to secure the target arm 140 in place. More particularly, the bolts are inserted through the opening 245 and then through the slot 255 so that the nut may be attached to the bolt on a backside of the arm section 145 thereby securing the target arm 140 in place. The length of the slot 255 dictates the degree of adjustment of the target face 120.

As also illustrated in FIGS. 1 through 4, the apertures 185-1 through 185-3 are spaced such that when the target device 100 is attached to a vertical post the target face 120 can be positioned in an upper, lower or horizontal position and when a target device 100 is attached to a horizontal post the target face 120 can be positioned in a left, right or central position. In such arrangements, the apertures 185-1 through 185-3 permit a single target face 120 to be positioned through an approximately 180° range of motion. It would require at least two, or even three, former target devices to cover the same goal area as the single target device 100 according to the embodiments of the present invention. While only three possible target face 120 positions are illustrated, it is obvious that numerous additional positions can be accommodated by the embodiments of the present invention.

While a target device 100 may be removably attached to a soccer goal post, cross-bar or other rigid post in any number of ways, FIG. 1 shows the support member 160 ready for secure attachment to a rigid elongated strut 180 which then has multiple straps 200 attached thereto. The straps 200 provide a mechanism for attaching the target device 100 to a rigid post. The straps 200 incorporate a buckle 205, having a pin 210 and a series of strap openings 215 for receipt of the buckle pin 210 to permit the straps 200 to accommodate various post sizes. The strut 180 can also be clamped or similarly joined to a post or the like. In one embodiment, the cross-section of the strut 180 is generally shaped to conform to the exterior cylindrical shape of a post. In other words, the strut 180 may have a concave surface which generally matches the contour of a cylindrical post.

FIG. 4 illustrates several of the target devices 100 having their target faces 120 in rotated positions throughout the goal area. It is obvious that the target devices 100 can be attached to any rigid post, including a hockey goal post or cross-bar and are not limited to use with a soccer goal.

Figure 5:
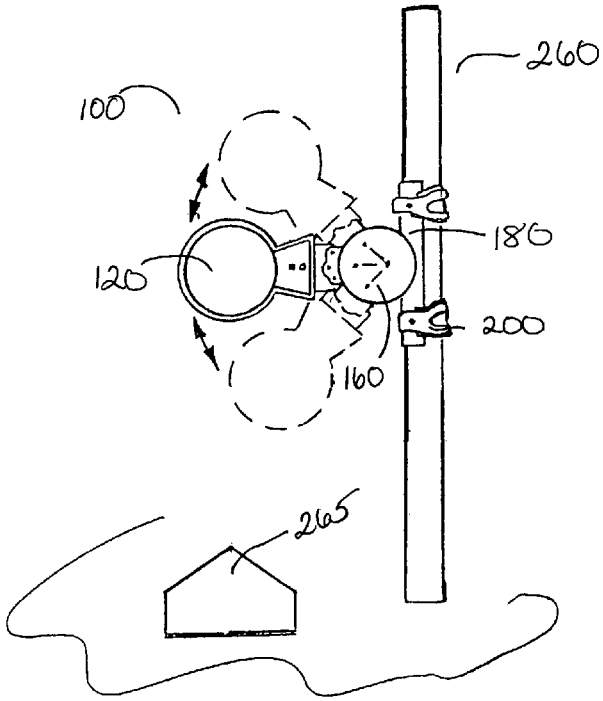
FIG. 5 illustrates a front view of a target device coupled to a single post in various positions (shown in dotted lines) for use in training a baseball pitcher.

In FIG. 5 a single target device 100 is shown attached to a single post 260 in an ideal embodiment for training baseball pitchers. The post 260 is secured such that the target face 120 is situated above a baseball plate 265. The target face 120 acts as a strike zone and is capable of being adjusted to reside in the heart of a baseball strike zone, high or low in the strike zone or inside or outside in the strike zone. As illustrated, the post 260 also acts to simulate a right-handed batter. The post 260 may also be positioned to simulate a left-handed batter. Upon impact, the target face 120 and first arm section 145 rotate in an opposite direction to the impact. The rotation causes the target face 120 to briefly exit the goal area. The hinge device 220 then causes the target face 120 and first arm section 145 to return to their original position. The automatic return is particularly useful with respect to the baseball embodiment illustrated in FIG. 5. As set forth above, in this baseball embodiment the target face 120 pivots in response to being struck by a baseball and automatically swings back to its original position.

Figure 6:
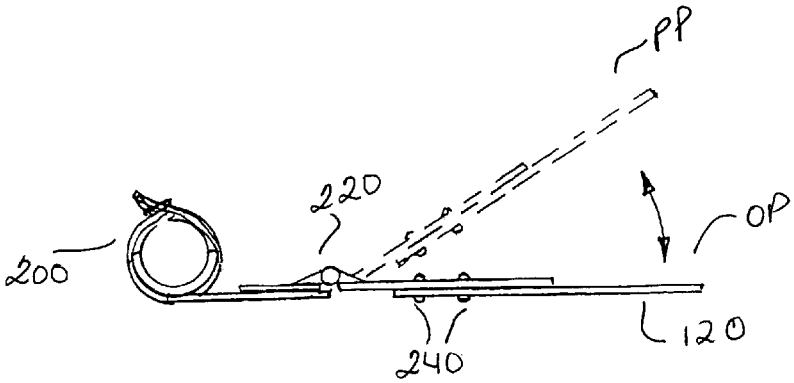
FIG. 6 is an illustration of a top view of a single target device in an original and pivoted position after being struck by a sports article.

FIG. 6 illustrates a top view of a single target device 100 with its target face 120 in an original position (OP) and a pivoted position (PP). In the pivoted position (PP), the target face 120 is temporarily removed from a contact area until the hinge 220 causes the target face 120 to swing back to its original position (OP).

While the figures show a circular target face 120 and target support member 160, each may take any desired shape, including that of a rectangle or triangle. In addition, the strut 180 and straps 200 are only one means for attaching the target device to a post. Other means include clamps, brackets, pins, screws, nails, etc.

Now referring to FIG. 7, a rear view of a portion of the target device 100 illustrates other features of the training device 100 including audible and visual indicators and a counter. A series of connected lights or LEDs 300 about a perimeter of the target face 120 are driven by a power source 310 permitting enhanced visualization of the target face 120 during both day and night training sessions. In the example shown the target face 120 and target face extension 250 are transparent so that the emitted light is viewable to a user. However, the LEDs 300 may also be placed on a front surface of the target face 120. In such an arrangement, a transparent protective covering may be necessary to prevent the LEDs 300 from being destroyed by a sports article. One or more lights or LEDs may also be positioned at or near a center of the target face 120 to illuminate an optimum target location. The center lights or LEDs may also cause a word or phrase such as "GOAL" to illuminate. Although shown attached to the first arm section 145, the power source 310 can be attached or integrated on any location of the target device 100.

An electrical counter 320 increments a running count by a single digit each time the target member 115 and corresponding target face 120 are pivoted about hinge 220 in response to being struck by a sports article. The counter 320 records the number of times the target member 115 has been successfully struck thereby allowing a user to track his or her performance. In one embodiment, an electrical counter 320 is in communication with a sensor 330, such as an optical sensor positioned near the hinge 220. The sensor 330 is triggered by sufficient angular displacement of the first arm section 145. As shown in FIG. 7, the sensor 330 is secured to a top surface (or bottom surface) of the hinge 220 and senses angular displacement of the target member 115 with respect to the original position of the target member 115. Thus, should the target member 115 pivot through a preestablished minimum angle (e.g., 75°) the sensor 330 sends, via wire 340, a signal to the counter 320 which correspondingly increments the count. The signal can also be sent via a wireless system. A mechanical counter may also be physically attached to the hinge 220 so that each sufficient movement of the hinge 220 increments the mechanical counter accordingly.

The electrical counter sensor 330 may also be used to drive a speaker 350. In response to receiving a signal from the sensor 330, the speaker 350 transmits an audio output. While the audible output may be any tone or sound, it is envisioned that cheers of a crowd or similar positive tones will enhance the training experience.

Therefore, although the invention has been described in detail with reference to several embodiments, additional variations and modifications exist within the scope and spirit of the invention as described and defined in the following claims.

I claim:

1. A training device comprising:

a target support adapted to be attached to a fixed goal of post;

a target member having a target face; and a rigid target arm joining said target support to said target member, said target arm rotatable in a semi-circular pattern in a generally vertical plane about said target support, said target arm lockable to the target support in multiple positions throughout the semi-circular pattern such that said target face may be locked in a plurality of unique horizontal and vertical positions without repositioning said target support, said target member pivotable in response to being struck by an article.

2. The training device according to claim 1 wherein said training device is attachable to a soccer goal post or cross-bar.

3. The training device according to claim 1 wherein said training device is attachable to a hockey goal post or cross-bar.

4. The training device according to claim 1 wherein said training device is attachable to a vertically secured post.

5. The training device according to claim 1 wherein said target support is attached to a concave strut which can then be strapped to a rigid member by means of flexible straps.

6. The training device according to claim 1 wherein said target arm is rotatable in a semi-circular pattern in a generally vertical plane about said target support by means of a plurality of spaced apertures incorporated in said target support, said openings for receipt of a pin for securing said target member in a desired position.

7. The training device according to claim 1 wherein said target arm rotatable in a semi-circular pattern in a generally vertical plane about said target support by means of a plurality of spaced pins integrated on a backside of said target support, said pins for insertion through an aperture in said target arm for securing said target member in a desired position.

8. The training device according to claim 1 wherein the target member is adjustable in a direction generally parallel to the target arm.

9. The training device according to claim 1 wherein the target member pivots about a hinge.

10. The training device according to claim 1 further comprising a counter for counting the number of successful strikes of the target member.

11. The training device according to claim 1 further comprising a series of lights illuminating said target face.

12. The training device according to claim 1 further comprising a speaker for transmitting audio outputs in response to successful strikes of the target member.

13. A method of training comprising:

attaching one or more target devices, having a rigid target arm, to a rigid member, said one or more target devices having a target member, including a target face, said target member pivotable in response to being struck by an article and rotatable in a semi-circular pattern in a generally vertical plane about a target support; and without re-positioning the target support, selecting a target member position for each target member from a plurality of position selections and locking said target member to the target support in the selected target member position wherein each of the plurality of positions have a corresponding unique horizontal and vertical component.

14. The method according to claim 13 wherein said rigid member is a soccer goal post or cross-bar.

15. The method according to claim 13 wherein said rigid member is a hockey goal post or cross-bar.

16. The method according to claim 13 wherein said rigid member is a post secured in the ground.

17. The method according to claim 13 further comprising selecting a target member position for each target member from a plurality of position selections generally parallel to said target arm.

18. The method according to claim 13 wherein the target member pivots about a hinge.

19. The method according to claim 13 further comprising counting the number of successful strikes of the target member by means of a counter.

20. The method according to claim 13 further comprising illuminating the target face with a series of lights.

21. The method according to claim 13 further comprising transmitting audio outputs via a speaker in response to successful strikes of the target member.

22. A training device for soccer comprising;

a plurality of target supports removably attachable to a soccer goal post, each said target support joined to a target member, having a target face, by a rigid target arm; and wherein said target arm is rotatable in a semi-circular pattern in a generally vertical plane about said target support, said target arm lockable to the target support in multiple positions throughout the semi-circular pattern such that said target face may be locked in a plurality of unique horizontal and vertical positions, within an area defined by the soccer goal posts, without repositioning said target support, said target members pivotable in response to being struck by the soccer ball.

23. The training device of claim 22 wherein the target member automatically returns to an original position after pivoting in response to being struck by the soccer ball.

24. A training device for baseball comprising:

a target support removably attachable to a vertically secured post, said target support joined to a target member, having a target face, by a rigid target arm; and wherein said target arm rotatable in a semi-circular pattern in a generally vertical plane about said target support, said target arm lockable to the target support in multiple positions throughout the semi-circular pattern such that said target face may be locked in a plurality of unique horizontal and vertical positions without repositioning said target support, said target member pivotable in response to being struck by the baseball.

25. The training device of claim 24 wherein the target member automatically returns to an original position after pivoting in response to being struck by the baseball.

* * * * *